US009528319B1

(12) United States Patent
Dostal

(10) Patent No.: US 9,528,319 B1
(45) Date of Patent: Dec. 27, 2016

(54) ICE AUGER REVERSAL ATTACHMENT

(71) Applicant: Thomas James Dostal, Badger, MN (US)

(72) Inventor: Thomas James Dostal, Badger, MN (US)

( * ) Notice: Subject to any disclaimer, the term of this patent is extended or adjusted under 35 U.S.C. 154(b) by 339 days.

(21) Appl. No.: 14/243,344

(22) Filed: Apr. 2, 2014

(51) Int. Cl.
*E21B 7/00* (2006.01)
*E21B 10/44* (2006.01)

(52) U.S. Cl.
CPC ..... *E21B 7/008* (2013.01); *E21B 10/44* (2013.01)

(58) Field of Classification Search
CPC ..... E21B 7/021; E21B 7/201; E21B 7/005; E21B 7/008; E21B 10/44; E21B 7/003; F25C 5/04
USPC ..... 175/170, 394; 173/170
See application file for complete search history.

(56) References Cited

U.S. PATENT DOCUMENTS 2,148,313 A * 2/1939 Williams ..... B64D 35/00 475/332
2,410,959 A * 11/1946 Brown ..... E21B 7/021 173/147
2,421,970 A * 6/1947 Smith ..... E21B 7/021 173/146
2,717,674 A * 9/1955 Crichton, Jr. ..... E21C 37/22 192/114 R
3,022,839 A * 2/1962 Troche ..... E02D 1/02 173/170
3,395,766 A 8/1968 Granville
3,407,888 A 10/1968 Graipin
3,565,190 A * 2/1971 Ishii ..... E21B 7/002 175/171
3,760,915 A 9/1973 Young
3,976,147 A 8/1976 Cunningham
4,601,348 A 7/1986 Cox
4,953,346 A * 9/1990 Aron ..... A01D 69/00 173/25
5,209,003 A 5/1993 Maxfield
5,570,975 A 11/1996 Reinert, Sr.
7,140,456 B2 11/2006 Maki
7,210,543 B1 5/2007 Sumner
2013/0081513 A1 4/2013 Ternovetsky

* cited by examiner

*Primary Examiner* — Michael Wills, III
(74) *Attorney, Agent, or Firm* — Neustel Law Offices; Jason L. Gilbert

(57) ABSTRACT

An ice auger reversal attachment which couples in-line with an ice auger to selectively reverse direction of the ice auger blade. The ice auger reversal attachment generally includes a mounting assembly adapted to be mounted to an ice auger motor. The mounting assembly includes a locking assembly which is adapted to selectively engage/disengage with an auger reversal assembly which is secured between the ice auger motor and the ice auger blade. Using the locking assembly and auger reversal assembly, the direction of rotation of the ice auger blade may be efficiently transitioned between a forward and reverse direction to aid in removal of slush when drilling a hole through a layer of ice.

19 Claims, 10 Drawing Sheets

ICE AUGER REVERSAL ATTACHMENT

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

Field of the Invention

The present invention relates generally to an ice auger attachment and more specifically it relates to an ice auger reversal attachment which couples in-line with an ice auger to selectively reverse direction of the ice auger blade.

Description of the Related Art

Any discussion of the related art throughout the specification should in no way be considered as an admission that such related art is widely known or forms part of common general knowledge in the field.

Ice augers are commonly used in colder environments to drill holes through thick ice. Perhaps the most common usage of an ice auger is for ice fishing, in which a hole is drilled through thick ice to allow a fishing line to enter the underlying body of water. The conventional method of drilling such a fishing hole is to use an ice auger running in a forward direction to drill down through the hole, and then manually pulling out the ice auger.

While the conventional methods of such auger use have been utilized for many years, it has been shown that merely pulling out a stationary ice auger blade from a drilled hole results in excessive slush around the hole opening. This can be detrimental to fishing. Thus, it is preferable to reverse the ice auger when removing from the drilled hole to reduce or eliminate the presence of such slush. However, many ice augers available on the market only operate in a single direction.

Because of the inherent problems with the related art, there is a need for a new and improved ice auger reversal attachment which couples in-line with an ice auger to selectively reverse direction of the ice auger blade.

BRIEF SUMMARY OF THE INVENTION

The invention generally relates to an ice auger reversal attachment which includes a mounting assembly adapted to be mounted to an ice auger motor. The mounting assembly includes a locking assembly which is adapted to selectively engage/disengage with an auger reversal assembly which is secured between the ice auger motor and the ice auger blade. Using the locking assembly and auger reversal assembly, the direction of rotation of the ice auger blade may be efficiently transitioned between a forward and reverse direction to aid in removal of slush when drilling a hole through a layer of ice.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto. In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

Figure 1:
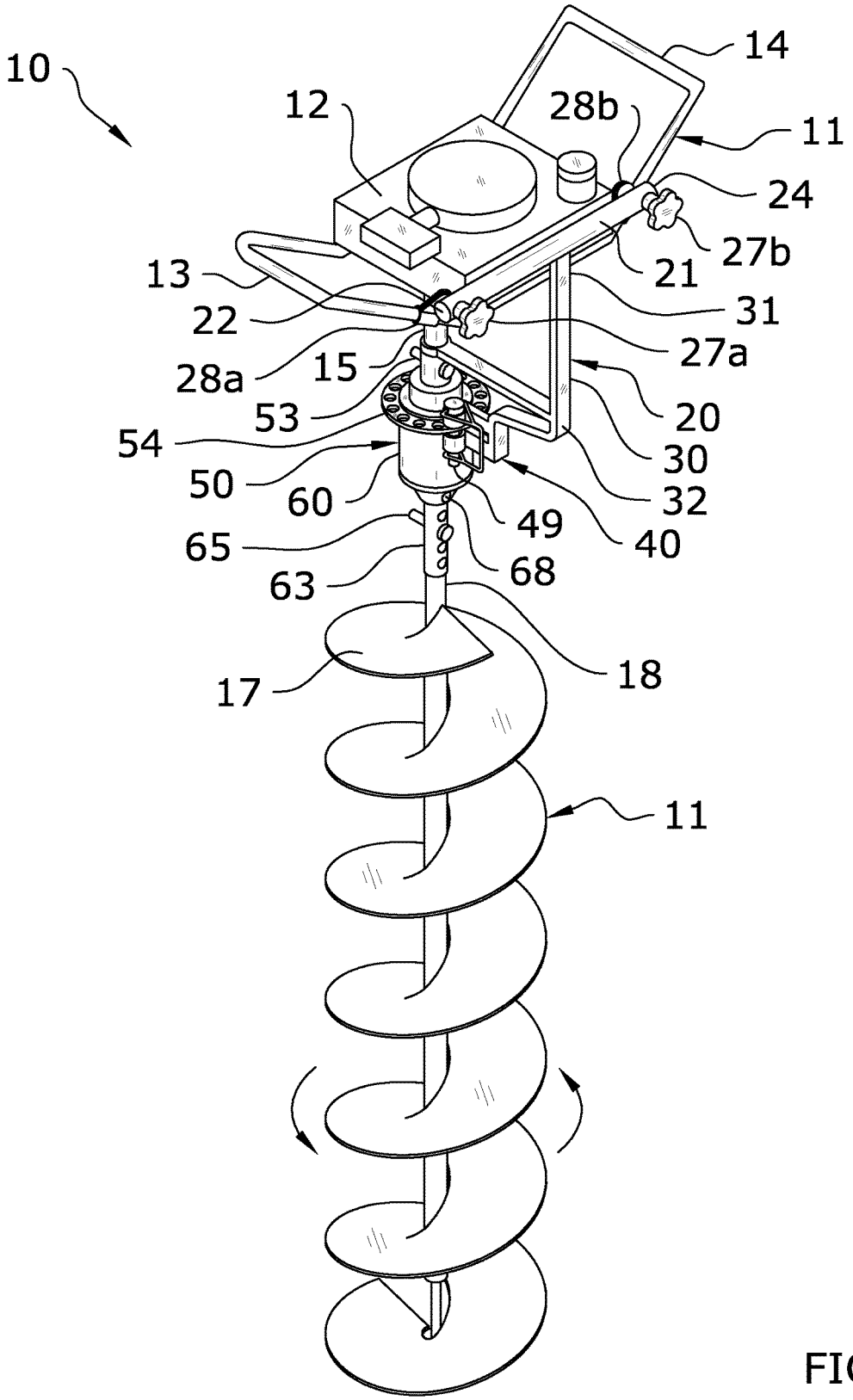
FIG. 1 is an upper perspective view of the present invention.

A. Overview.

Turning now descriptively to the drawings, in which similar reference characters denote similar elements throughout the several views, FIGS. 1 through 10 illustrate an ice auger reversal attachment 10, which comprises a mounting assembly 20 adapted to be mounted to an ice auger motor 12. The mounting assembly 20 includes a locking assembly 40 which is adapted to selectively engage/disengage with an auger reversal assembly 50 which is secured between the ice auger motor 12 and the ice auger blade 17. Using the locking assembly 40 and auger reversal assembly 50, the direction of rotation of the ice auger blade 17 may be efficiently transitioned between a forward and reverse direction to aid in removal of slush when drilling a hole through a layer of ice.

B. Ice Auger.

As shown throughout the figures, the present invention is adapted to be installed in-line on an ice auger 11 between the ice auger motor 12 and the ice auger blade 17. It should be appreciated that the figures merely illustrate an exemplary ice auger 11. The flexibility of the present invention to work with a wide range of ice auger 11 designs is one of its primary features. Thus, the present invention should not be construed as limited to any particular design of ice auger 11.

In the configuration shown in the figures, an exemplary ice auger 11 comprises an ice auger motor 12 and an ice auger blade 17. The ice auger 11 will generally include one or more handles 13, 14 extending from the ice auger motor 12. An auger mount 15 will generally extend downwardly from the ice auger motor 12 to mount the ice auger blade 17 to the ice auger motor 12. The auger mount 15 includes a locking aperture 16 which is conventionally adapted to engage with a corresponding connection member 18 extending upwardly from the ice auger blade 17.

Figure 2:
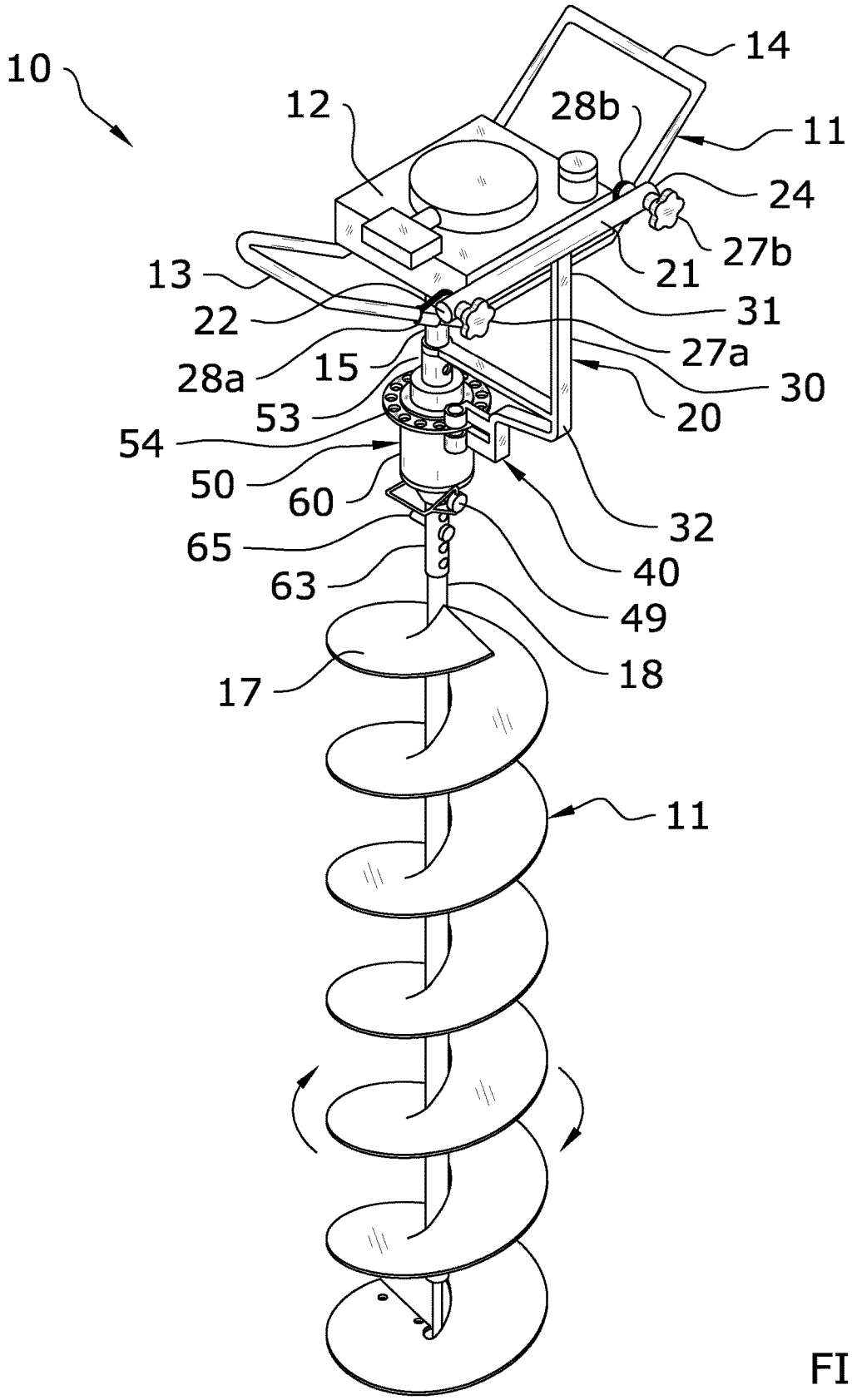
FIG. 2 is an upper perspective view of the present invention with the locking pin disengaged.
Figure 3:
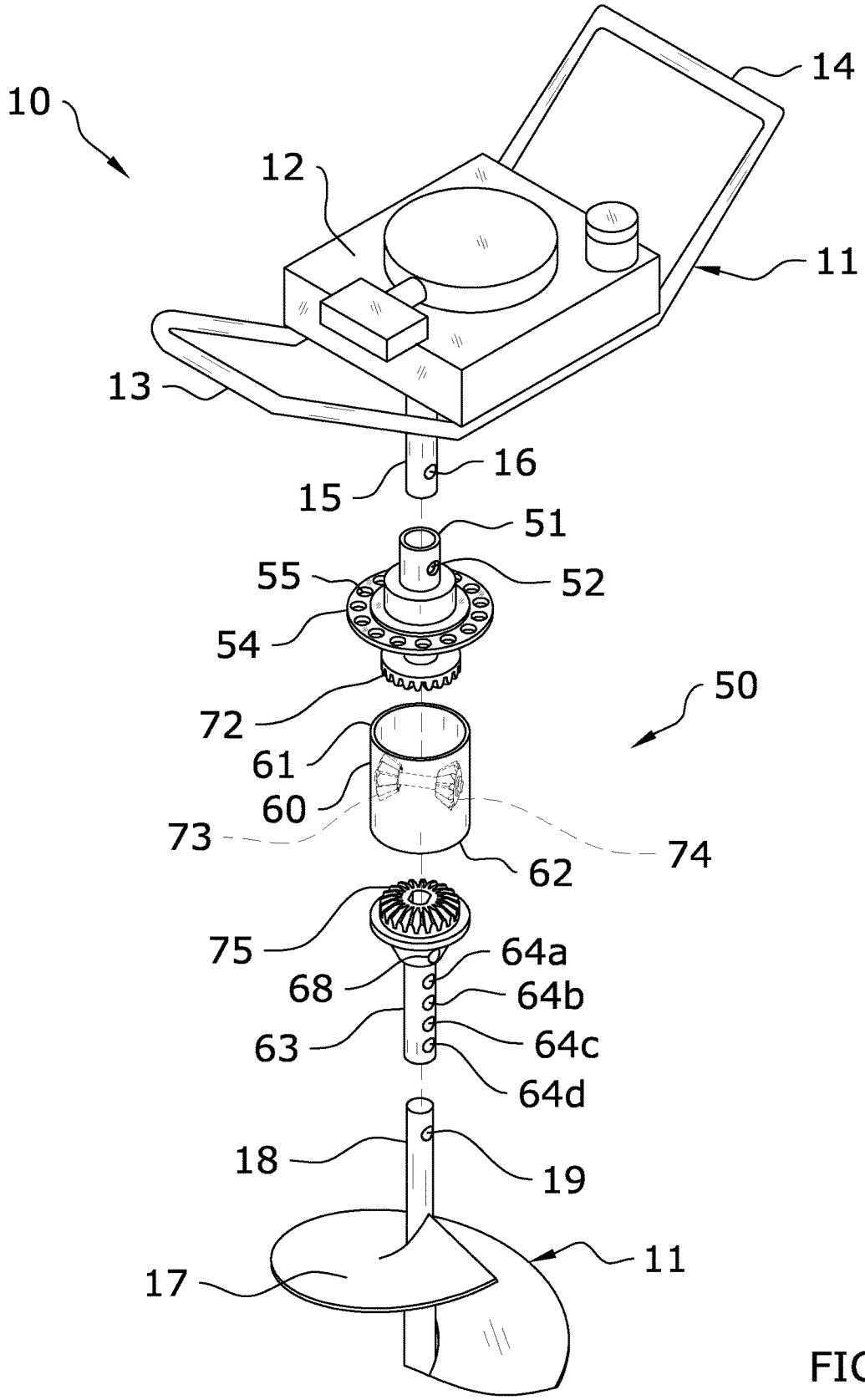
FIG. 3 is an exploded upper perspective view of the differential embodiment of the present invention.

The present invention is adapted for use with a wide range of ice augers 11. When using the present invention, the ice auger blade 17 will first be removed from the ice auger motor 12. The present invention will be installed between the auger mount 15 of the ice auger motor 12 and the connection member 18 of the ice auger blade 17 as best shown in FIGS. 1-3.

B. Mounting Assembly.

As best shown in FIGS. 1, 2, 7, and 8, the present invention includes a mounting assembly 20 adapted to mount to an ice auger motor 12. The mounting assembly 20 acts to secure the locking assembly 40 of the present invention in a position from which it may be utilized to engage or disengage with the auger reversal assembly 50 to alternate between forward and reverse operation of the ice auger blade 17.

It should be appreciated that the structure and configuration of the mounting assembly 20 may vary in different embodiments. Due to the different configurations and sizes of ice augers 11, the structure and configuration of the mounting assembly 20 may vary to accommodate these different ice auger 11 configurations. The dimensions in particular will vary to accommodate larger or smaller ice augers 11. Different handle 13, 14 configurations on different ice augers 11 will also be accommodated by different embodiments of the mounting assembly 20.

In an exemplary embodiment shown in the figures, the mounting assembly 20 includes a cross bar 21 and an extension member 30 which extends downwardly from the cross bar 21. The extension member 30 includes the locking assembly 40 which is discussed in more detail in the following section.

As best shown in FIGS. 1 and 2, the cross bar 21 is utilized to removably secure the mounting assembly 20 to the ice auger 11. Specifically, the cross bar 21 is generally secured to the ice auger motor 12, such as via its handles 13, 14. In a preferred embodiment, the cross bar 21 comprises an elongated member having a first end 22 and a second end 24. The first end 22 of the cross bar 21 includes a first aperture 23 and the second end 24 of the cross bar 21 includes a second aperture 25.

To secure the mounting assembly 20 to the ice auger motor 12, a first handle linkage **28*a* is positioned around the first handle 13 and a second handle linkage 28*b* is positioned around the second handle 14. The handle linkages 28*a,b* generally comprise a looped bracket connector as shown in the figures. Various other types of brackets may be utilized, however, such as to secure the cross bar 21 to the ice auger motor 12 itself for use with ice augers 11 that may not necessary have a handle 13, 14 configuration adapted to work with the handle linkages 28*a,b*** shown.

After the handle linkages **28*a,b* are secured to the handles 13, 14, a first fastener 26*a* is installed through both the first aperture 23 of the cross bar 21 and the first handle linkage 28*a*. Similarly, a second fastener 26*b* is installed through both the second aperture 24 of the cross bar 21 and the second handle linkage 28*b*. The first fastener 26*a* will generally include a first knob 28*a* and the second fastener 26*b* will generally include a second knob 28*b* to aid in installation. A first retaining nut 29*a* will be utilized to secure the first fastener 26*a* and a second retaining nut 29*b* will be utilized to secure the second fastener 26*b***.

The extension member 30 extends downwardly from the cross bar 21 a length sufficient to place the locking assembly 40 at the proper height to engage with the auger reversal assembly 50. This length will vary for different ice auger 11 configurations, so the dimensions and configuration shown in the figures should not be construed as limiting.

Figure 6:
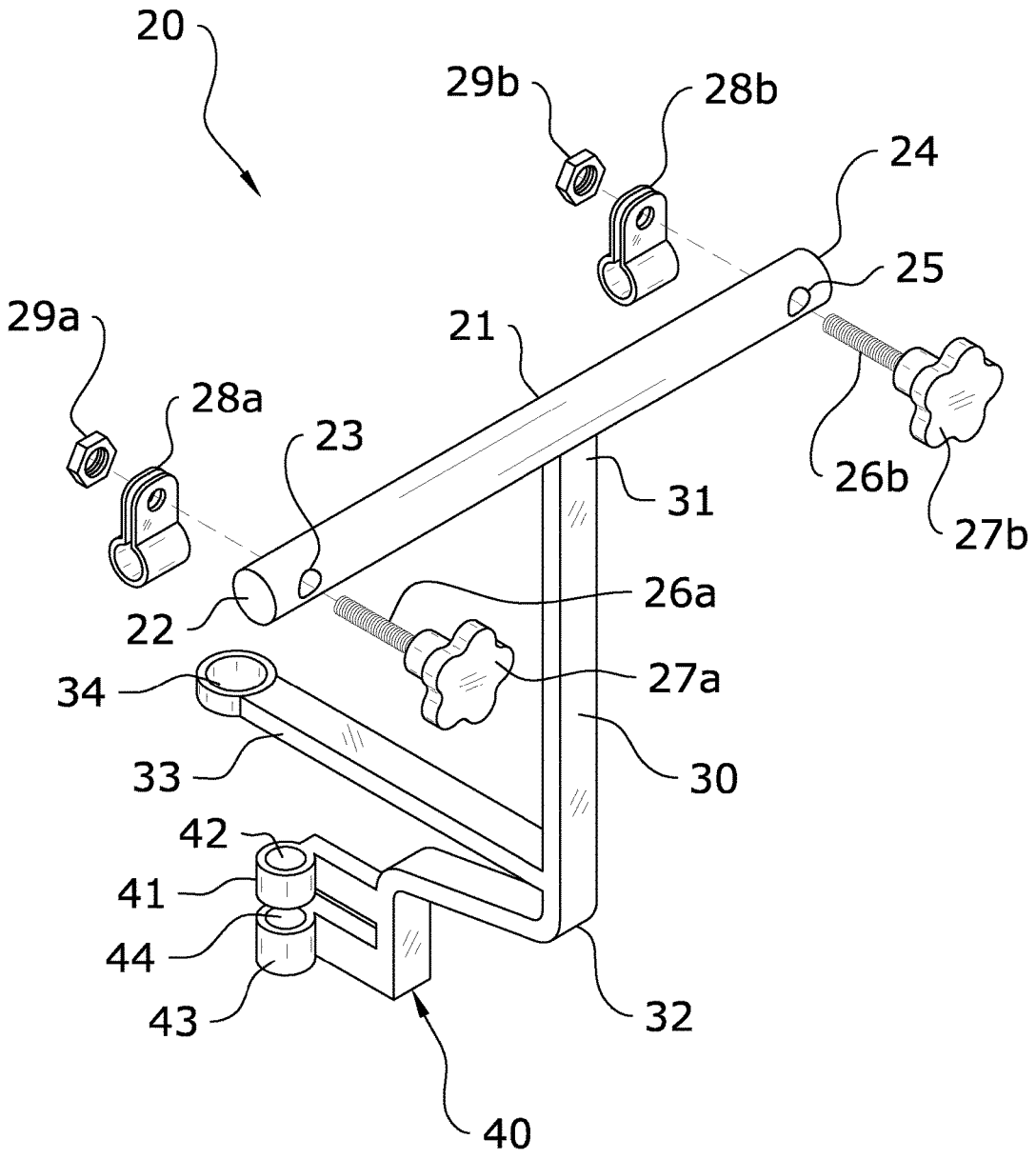
FIG. 6 is an upper perspective view of a first embodiment of the locking assembly of the present invention.
Figure 7:
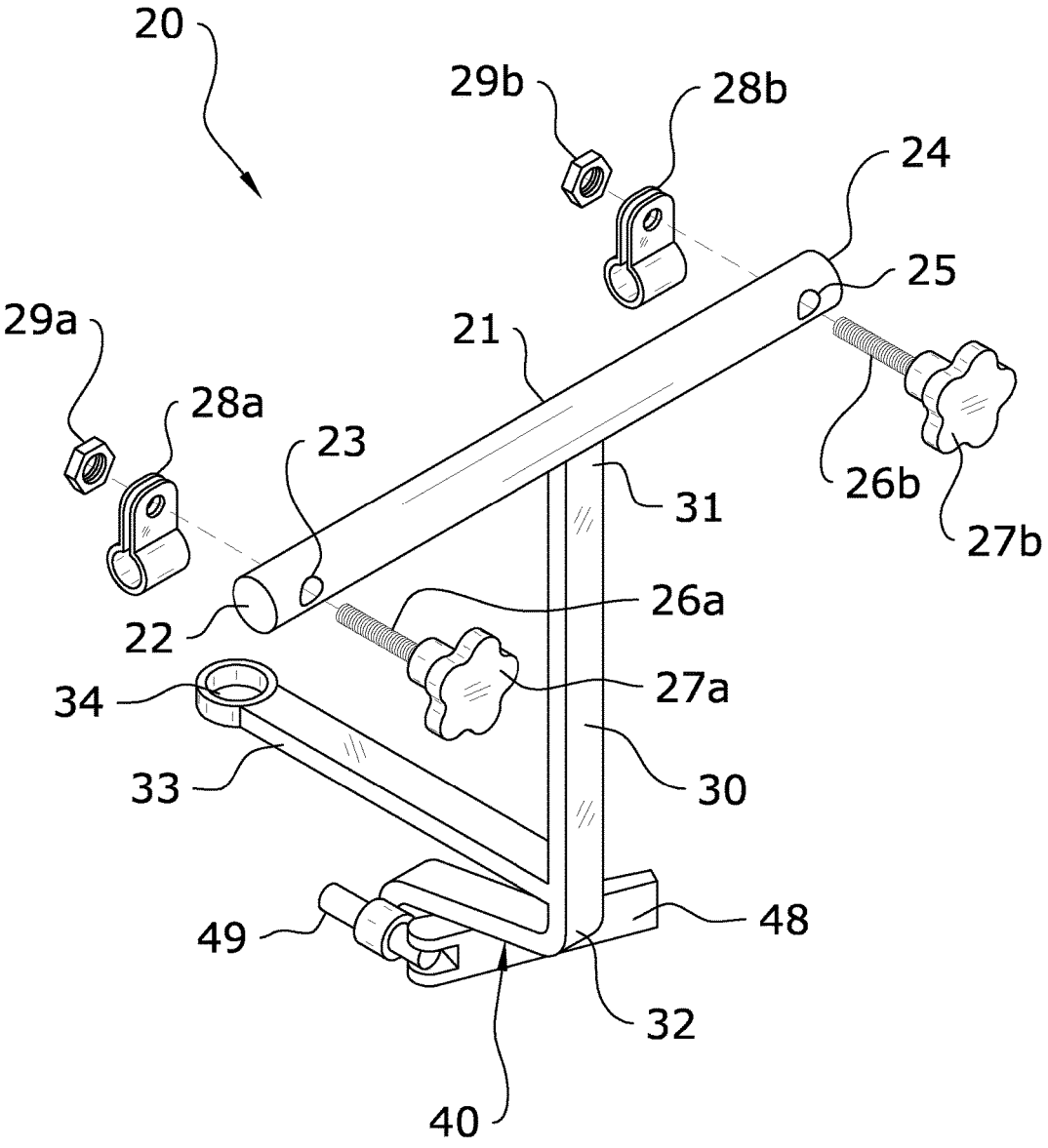
FIG. 7 is an upper perspective view of a second embodiment of the locking assembly of the present invention.

As best shown in FIGS. 6 and 7, the extension member 30 includes an upper end 31 and a lower end 32. The upper end 31 of the extension member 30 is connected to or integrally formed with a central point on the length of the cross bar 21. The lower end 32 of the extension member 30 is connected to or integrally formed with the locking assembly 40 of the present invention.

The mounting assembly 20 may also include a mount receiver 33 extending from a point adjacent to the lower end 32 of the extension member 30. Generally, the mount receiver 33 comprises an elongated member which extends perpendicularly with respect to the extension member 30 and includes a mount opening 34. The auger mount 15 of the ice auger motor 12 will extend through the mount opening 34 as best shown in FIGS. 1 and 2 to securely connect the mounting assembly 20 to the ice auger 11.

C. Locking Assembly.

As shown throughout the figures, the present invention utilizes a locking assembly 40 to selectively engage with and lock the auger reversal assembly 50. Using the locking assembly 40, the ice auger 11 may be easily transitioned between a forward and reverse motion.

Two exemplary embodiments of the locking assembly 40 are shown in FIGS. 6 and 7. In both cases, the locking assembly 40 extends from a lower end 32 of the extension member 30 at a height sufficient to allow engagement with the auger reversal assembly 50. The locking assembly 40 may be connected to, or integrally formed with, the extension member 30.

In the embodiment shown in FIG. 6, the locking assembly 40 includes an upper pin receiver 41 and a lower pin receiver 43. The upper and lower pin receivers 41, 43 extend parallel with respect to each other. The upper pin receiver 41 includes an upper pin aperture 42 and the lower pin receiver 43 includes a lower pin aperture 44, wherein the upper pin aperture 42 and lower pin aperture 44 are aligned so as to allow a locking pin 46 to extend through both at the same time.

The upper and lower pin receivers 41, 43 define a horizontal disc slot 45 therebetween. The outer disc 54 of the auger reversal assembly 50 is positioned within the disc slot 45 and allowed to freely rotate therein when the locking assembly 40 is not engaged. A locking pin 46 is provided which may be selectively and removably inserted through the upper and lower pin receivers 41, 43 to lock the outer disc 54 in place and prevent rotation thereof. This action will cause the ice auger blade 17 to transition between forward and reverse directions.

In the embodiment shown in FIG. 7, a lever 48 is pivotally connected to the lower end 32 of the extension member 30. A distal end of the lever 48 includes a pivotally secured locking rod 49. By manipulation of the lever 48, the locking rod 49 may be selectively and removably engaged with the outer disc 54 of the auger reversal assembly 50 to transition the ice auger blade 17 between forward and reverse directions.

D. Auger Reversal Assembly.

The present invention utilizes an auger reversal assembly 50 to transition the ice auger blade 17 between forward and reverse directions. The auger reversal assembly 50 is installed in-line between the ice auger motor 12 and the ice auger blade 17 as shown throughout the figures. The auger reversal assembly 50 is not directly connected to the mounting assembly 20, but is selectively engaged by the locking assembly 40 to alternate between directions.

The structure and configuration of the auger reversal assembly 50 may vary in different embodiments. The exemplary figures herein illustrate two potential embodiments which incorporate a differential reversal assembly 70 and a planetary reversal assembly 80. It should be appreciated that other configurations may be utilized in different embodiments.

Figure 4:
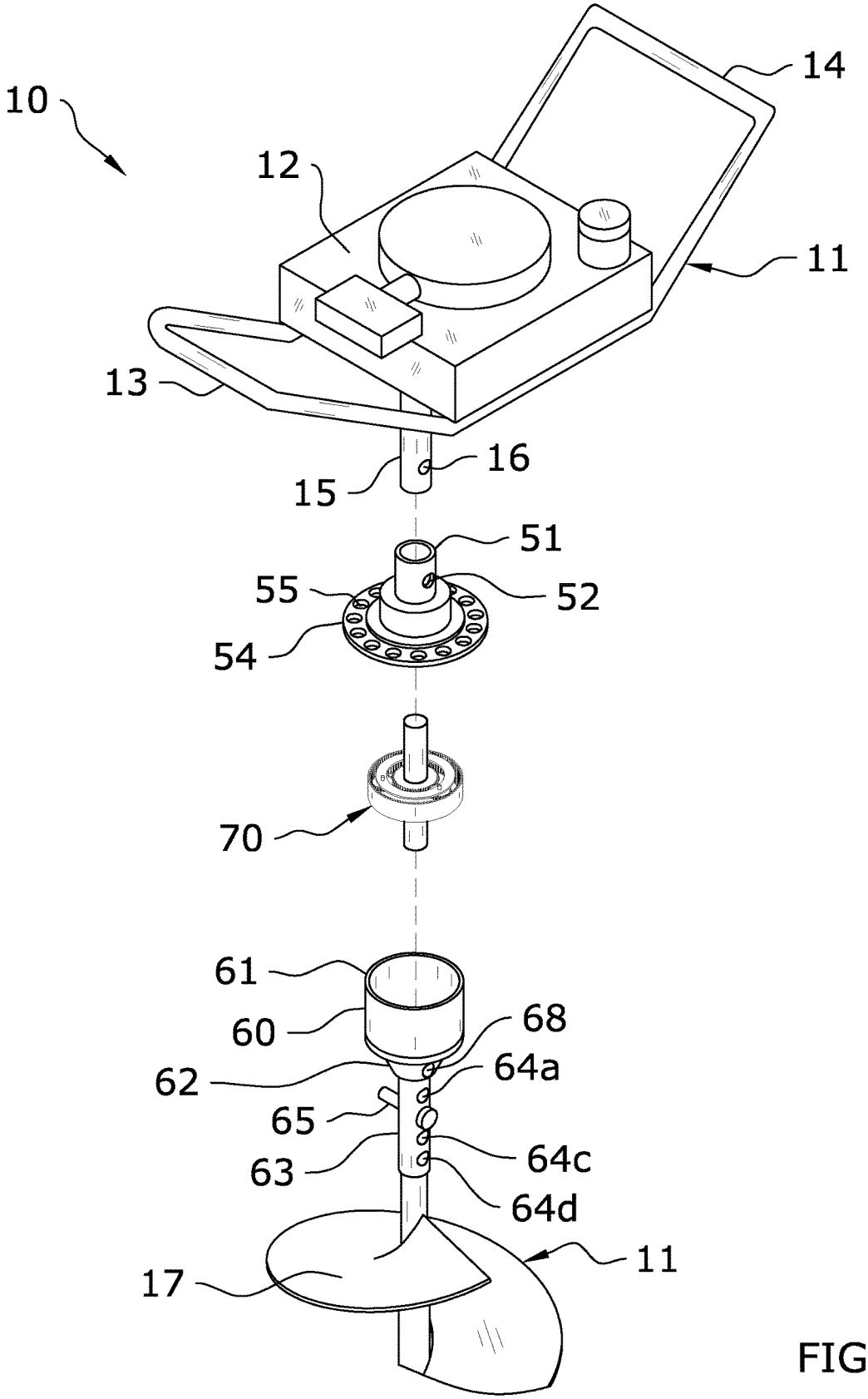
FIG. 4 is an exploded upper perspective view of the planetary embodiment of the present invention.
Figure 5:
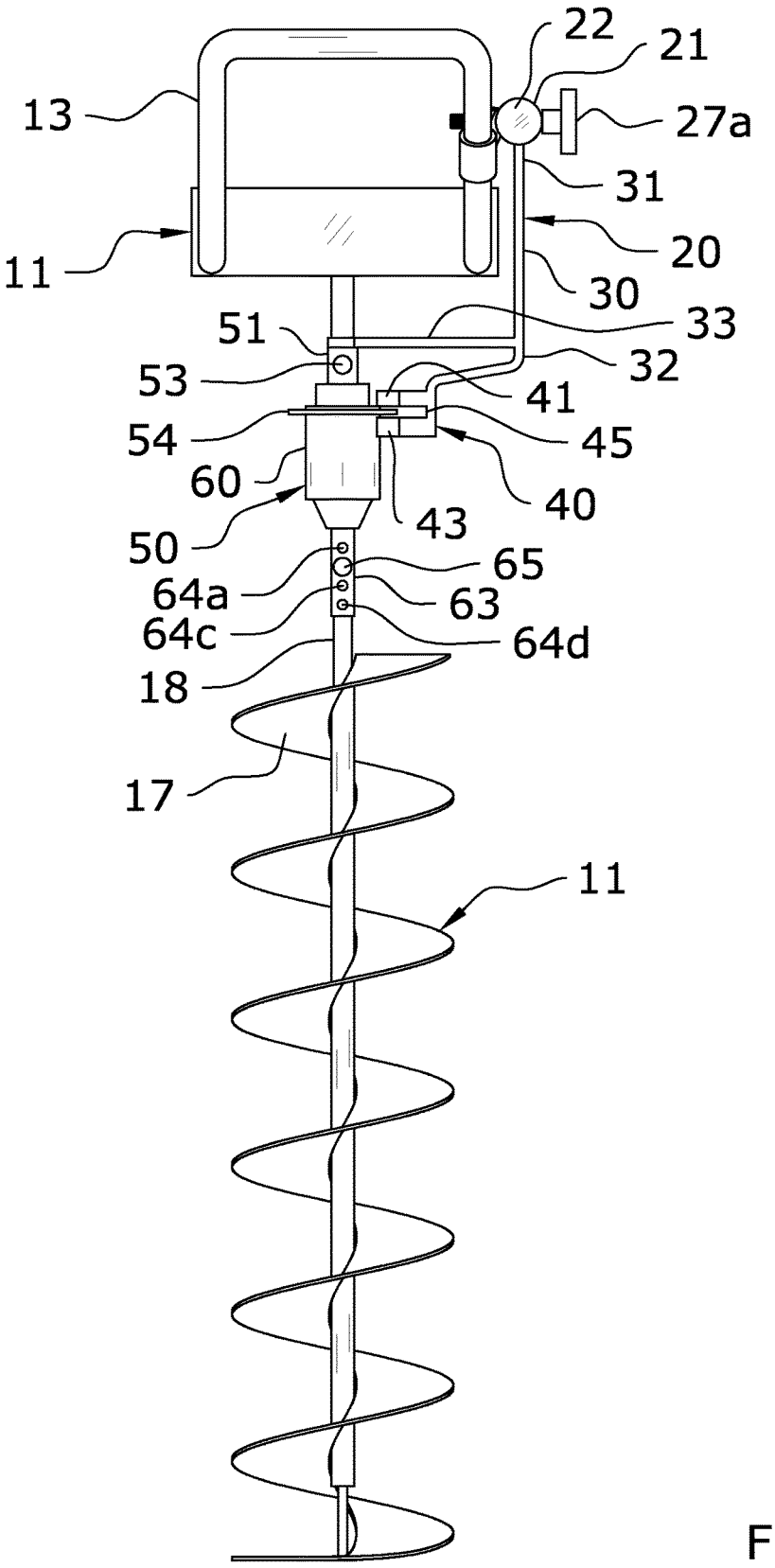
FIG. 5 is a frontal view of the present invention.

The auger reversal assembly 50 will generally include an upper connector 51 adapted to be removably connected to the auger mount 15 of the ice auger motor 12. As best shown in FIGS. 3 and 4, the upper connector 51 includes a mounting aperture 52. When the upper connector 51 is matingly engaged with the auger mount 15, the mounting aperture 52 will be aligned with the locking aperture 16 and a mounting pin 53 extended through both apertures 16, 52 to removably connect the auger reversal assembly 50 to the auger mount 15.

The auger reversal assembly 50 also generally includes an outer disc 54 extending over an outer housing 60. The outer disc 54 is engaged or disengaged by the locking assembly 40 to transition the ice auger 11 between forward and reverse rotation. The structure of the outer disc 54 may vary in different embodiments.

In the embodiment shown in FIGS. 1-4, the outer disc 54 includes a plurality of outer apertures 55 into which the locking pin 46 of the locking assembly 40 may be removably positioned to alternate direction of the ice auger 11. In the embodiment shown in FIGS. 9-10, the outer disc 54 includes a plurality of outer notches 56 into which the locking rod 49 of the locking assembly 40 may be positioned to alternate direction of the ice auger 11.

The outer housing 60 of the auger reversal assembly 50 will store a differential reversal assembly 70, planetary reversal assembly 80, or other structure adapted to reverse direction of the ice auger blade 17 upon engaged/disengagement of the locking assembly 40. The upper end 61 of the outer housing 60 is secured to or integrally formed with the outer disc 54 and upper connector 50.

The lower end 62 of the outer housing 60 also includes an auger receiver 63 which is adapted to matingly and removably engage with the connection member 18 of the ice auger blade 17. The auger receiver 63 will preferably include a plurality of receiver apertures 64*a,b,c,d* along its length. By selecting one of these receiver apertures 64*a,b,c,d* and aligning with the corresponding locking aperture 19 of the connection member 18 of the ice auger blade 17, the ice auger blade 17 may be removably secured to the auger reversal assembly 50. The use of multiple receiver apertures 64*a,b,c,d* allows for the effective length of the ice auger blade 17 to be alternated for different uses. A receiver pin 65 is utilized to extend through and connect the auger receiver 63 with the connection member 18 of the ice auger blade 17.

As shown throughout the figures, the lower end 62 of the outer housing 60 may be tapered prior to terminating into the auger receiver 63. A locking aperture 68 extends through the lower end 62 of the outer housing 60. When the locking pin 49 is installed within the locking aperture 68, the auger reversal assembly 50 will be locked to allow the auger blade 11 to rotate in a forward direction as shown in FIG. 2.

i. Differential Reversal Assembly.

FIG. 3 illustrates an exemplary embodiment of a differential reversal assembly 70 which generally comprises a differential gear configuration adapted to allow reversal of the ice auger blade 17. Various types of differentials may be utilized with the present invention, and the scope of the present invention should not be construed as being limited by the exemplary figures.

In the embodiment shown in the figures, the differential reversal assembly 70 is comprised of a beveled configuration. An upper gear 72 and lower gear 75 are separated by a first bevel gear 73 and a second bevel gear 74. The upper and lower gears 72, 75 are arranged horizontally while the first and second bevel gears 73, 74 are positioned vertically between the upper and lower gears 72, 75.

When the locking assembly 40 is engaged to the outer housing 50, the differential reversal assembly 70 will act to reverse the direction of the ice auger blade 17. When the locking pin 46 is positioned within the locking aperture 68, the differential reversal assembly 70 will be bypassed to allow forward direction of the ice auger blade 17.

ii. Planetary Reversal Assembly.

Figure 8:
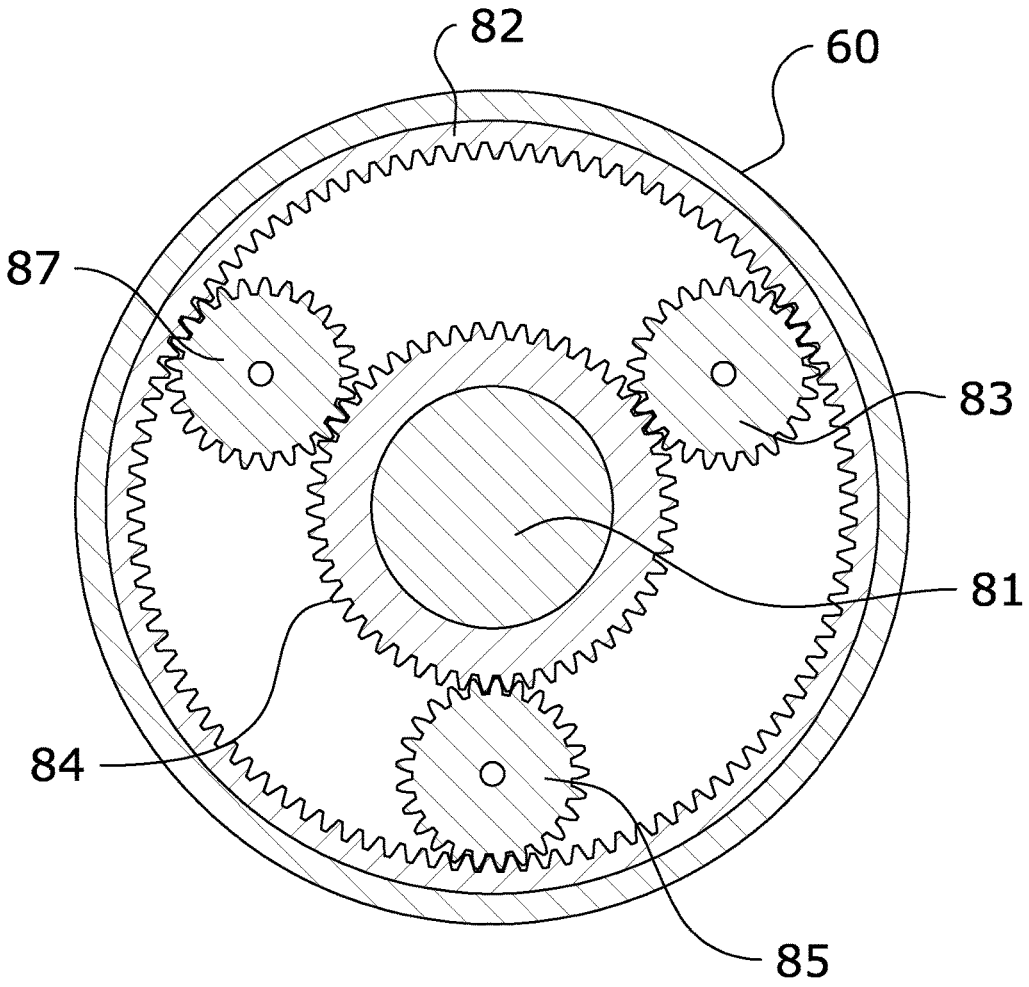
FIG. 8 is a frontal sectional view of a planetary reversal assembly for use with the present invention.
Figure 9:
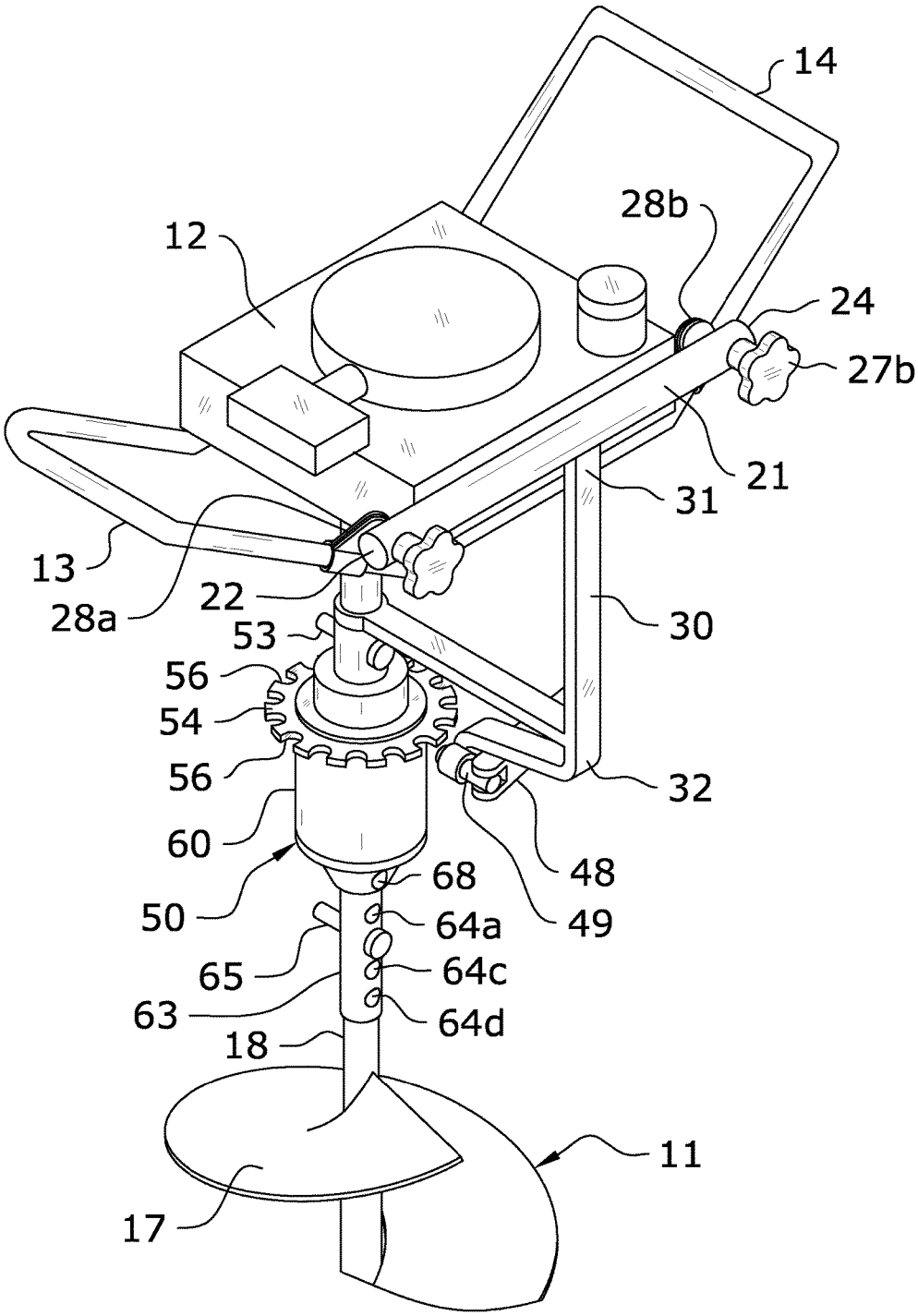
FIG. 9 is an upper perspective view of the second embodiment of a locking assembly in a disengaged position.
Figure 10:
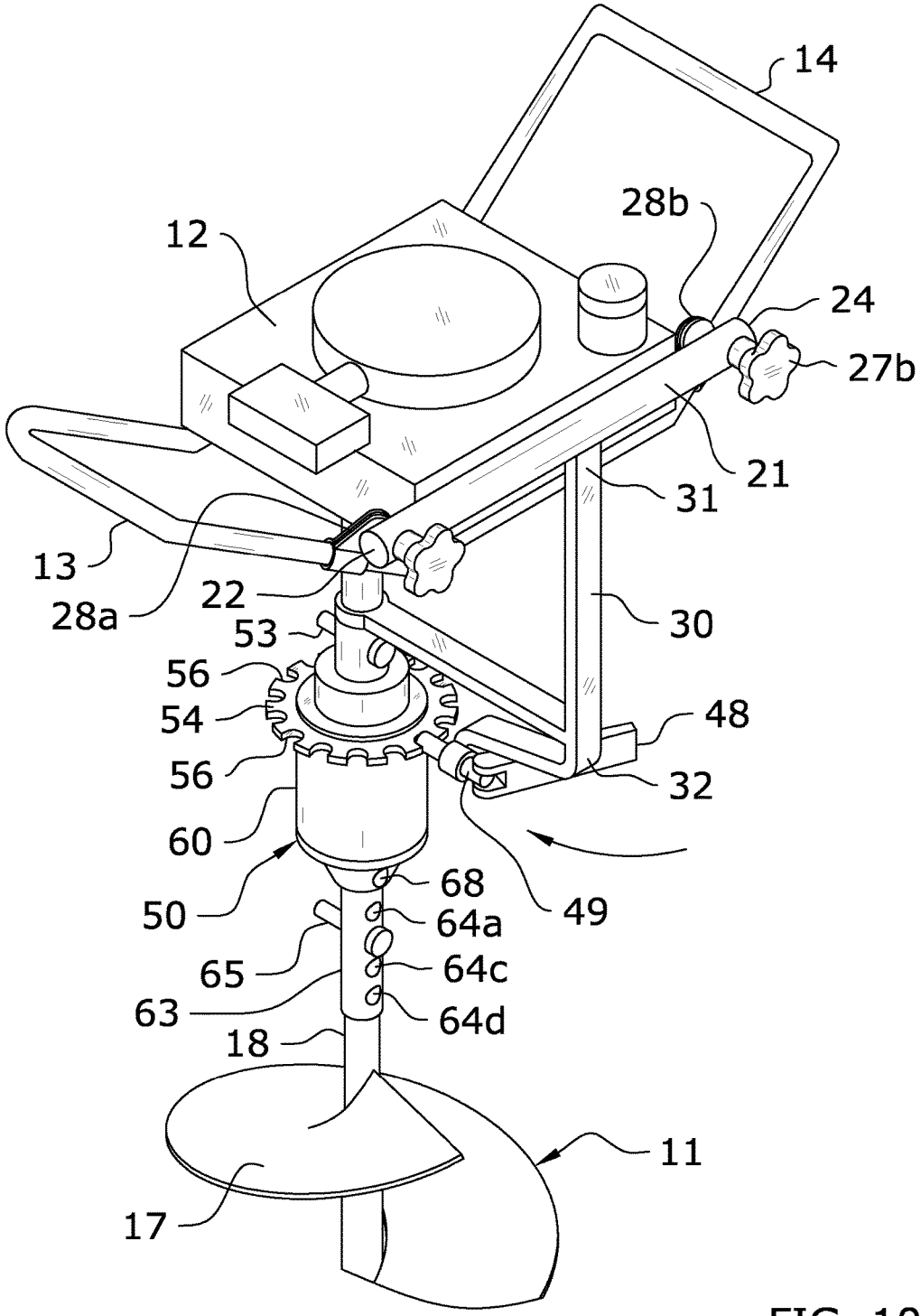
FIG. 10 is an upper perspective view of the second embodiment of a locking assembly in an engaged position.

FIGS. 4 and 8 illustrate an exemplary embodiment of a planetary reversal assembly 80 which generally comprises a planetary gear configuration adapted to allow reversal of the ice auger blade 17. Various types of planetary gears may be utilized with the present invention, and the scope of the present invention should not be construed as being limited by the exemplary figures.

In the embodiment shown it the figures, the planetary reversal assembly 80 is positioned within the outer housing 60 and includes a first outer gear 83, an inner gear 84, a second outer gear 85, and a third outer gear 87 which are arranged in a planetary configuration within a gear track 82 as known in the art. Upper bearings may be positioned above the gears 83, 84, 85 and lower bearings may be positioned below the gears 83, 84, 85 to encourage rotational movement if needed.

A central rod 81 extends through the planetary reversal assembly 80 as best shown in FIG. 8. When the locking assembly 40 is engaged to the outer housing 50, the planetary reversal assembly 80 will act to reverse the direction of the ice auger blade 17. When the locking pin 46 is positioned within the locking aperture 68 to engage the central rod 81, the planetary reversal assembly 80 will be bypassed to allow forward direction of the ice auger blade 17.

E. Operation of Preferred Embodiment.

In use, the ice auger blade 17 is first removed from the ice auger motor 12. To secure the mounting assembly 20 to the ice auger motor 12, a first handle linkage 28*a* is positioned around the first handle 13 and a second handle linkage 28*b* is positioned around the second handle 14. The handle linkages 28*a,b* generally comprise a looped bracket connector as shown in the figures. Various other types of brackets may be utilized, however, such as to secure the cross bar 21 to the ice auger motor 12 itself for use with ice augers 11 that may not necessary have a handle 13, 14 configuration adapted to work with the handle linkages 28*a,b* shown.

After the handle linkages 28*a,b* are secured to the handles 13, 14, a first fastener 26*a* is installed through both the first aperture 23 of the cross bar 21 and the first handle linkage 28*a*. Similarly, a second fastener 26*b* is installed through both the second aperture 24 of the cross bar 21 and the second handle linkage 28*b*. The first fastener 26*a* will generally include a first knob 28*a* and the second fastener 26*b* will generally include a second knob 28*b* to aid in installation. A first retaining nut 29*a* will be utilized to secure the first fastener 26*a* and a second retaining nut 29*b* will be utilized to secure the second fastener 26*b*. The auger mount 15 of the ice auger motor 12 will also be positioned through the mount opening 34 of the mount receiver 33 of the extension member 30.

The auger reversal assembly 50 may then be secured to the ice auger motor 12. The upper connector 51 of the auger reversal assembly 50 is engaged and locked with the auger mount 15 of the ice auger motor 12. The ice auger blade 17 may then be engaged and locked with the auger reversal assembly 50 by engaging and locking the connection member 18 of the ice auger blade 17 with the auger receiver 63 at the lower end 62 of the outer housing 60. The user may select a specific receiver aperture 64*a,b,c,d* to set the desired effective length of the ice auger blade 17.

With the present invention properly installed between the ice auger motor 12 and the ice auger blade 17, the ice auger 11 may be operated. The locking assembly 40 may be selectively engaged/disengaged by using either the locking pin 46 or the lever 48 and locking rod 49 to lock/unlock the auger reversal assembly 50. By selectively engaging/disengaging the locking pin 46 or locking rod 49, the direction of rotation of the ice auger blade 17 may be transitioned between forward and reverse directions.

Unless otherwise defined, all technical and scientific terms used herein have the same meaning as commonly understood by one of ordinary skill in the art to which this invention belongs. Although methods and materials similar to or equivalent to those described herein can be used in the practice or testing of the present invention, suitable methods and materials are described above. All publications, patent applications, patents, and other references mentioned herein are incorporated by reference in their entirety to the extent allowed by applicable law and regulations. The present invention may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

The invention claimed is:

1. An ice auger reversal attachment, comprising:

a mounting assembly adapted to be mounted to an ice auger motor;

a locking assembly extending from said mounting assembly; and an auger reversal assembly adapted to be mounted between said ice auger motor and an ice auger blade, wherein said locking assembly is adapted to engage or disengage with said auger reversal assembly to select a direction of rotation of said ice auger blade, wherein said auger reversal assembly includes an upper connector for engaging with said ice auger motor, an outer housing, and an auger receiver for engaging with said ice auger blade.

2. The ice auger reversal attachment of claim 1, wherein said auger reversal assembly includes a differential reversal assembly.

3. The ice auger reversal attachment of claim 2, wherein said differential reversal assembly is positioned within said outer housing.

4. The ice auger reversal attachment of claim 3, wherein said differential reversal assembly comprises an upper gear, a lower gear, and at least one bevel gear connecting said upper gear with said lower gear.

5. The ice auger reversal attachment of claim 1, wherein said auger reversal assembly includes a planetary reversal assembly.

6. The ice auger reversal attachment of claim 5, wherein said planetary reversal assembly comprises a first outer gear, a second outer gear, and an inner gear connecting said first outer gear with said second outer gear.

7. The ice auger reversal attachment of claim 6, wherein said planetary reversal assembly further comprises a central rod.

8. The ice auger reversal attachment of claim 1, wherein said auger receiver is comprised of an elongated member having a plurality of spaced receiver apertures extending along its length.

9. The ice auger reversal attachment of claim 1, wherein said mounting assembly comprises a cross bar, an extension member extending from said cross bar, and a locking assembly extending from said extension member.

10. The ice auger reversal attachment of claim 9, wherein said cross bar is adapted to be removably secured to an ice auger motor.

11. The ice auger reversal attachment of claim 10, further comprising a first handle linkage adapted to connect said cross bar with a first handle of said ice auger motor.

12. The ice auger reversal attachment of claim 11, further comprising a second handle linkage adapted to connect said cross bar with a second handle of said ice auger motor.

13. The ice auger reversal attachment of claim 12, further comprising a first aperture positioned at a first end of said cross bar and a second aperture positioned at a second end of said cross bar, wherein said first handle linkage is connected to said first end of said cross bar via a first fastener extending through said first aperture and wherein said second handle linkage is connected to said second end of said cross bar via a second fastener extending through said second aperture.

14. The ice auger reversal attachment of claim 1, wherein said auger reversal assembly includes an outer disc, wherein said locking assembly is adapted to removably engage with said outer disc.

15. The ice auger reversal attachment of claim 14, wherein said outer disc includes a plurality of outer apertures along its outer circumference.

16. The ice auger reversal attachment of claim 15, wherein said locking assembly includes a locking pin adapted to engage said locking assembly with one of said outer apertures of said outer disc.

17. The ice auger reversal attachment of claim 14, wherein said outer disc includes a plurality of outer notches along its outer circumference.

18. The ice auger reversal attachment of claim 17, wherein said locking assembly includes a pivotally connected lever.

19. The ice auger reversal attachment of claim 18, wherein said pivotally connected lever includes a locking rod adapted to engage with one of said plurality of outer notches.

* * * * *